US005475975A

United States Patent [19]

Nasu

[11] Patent Number: 5,475,975

[45] Date of Patent: Dec. 19, 1995

[54] AIR-FUEL RATIO CONTROL DEVICE FOR AN ENGINE

[75] Inventor: Masahiro Nasu, Susono, Japan

[73] Assignee: Toyota Jidosha Kabushiki Kaisha, Toyota, Japan

[21] Appl. No.: 305,641

[22] Filed: Sep. 14, 1994

[30] Foreign Application Priority Data

Sep. 21, 1993 [JP] Japan ..... 5-234950

[51] Int. Cl.[6] ..... F01N 3/20

[52] U.S. Cl. ..... 60/276; 60/285

[58] Field of Search ..... 60/276, 277, 285

[56] References Cited

U.S. PATENT DOCUMENTS

| | | | |
|---|---|---|---|
| 4,739,614 | 4/1988 | Katsuno et al. . | |
| 5,077,970 | 1/1992 | Hamburg | 60/276 |
| 5,088,281 | 2/1992 | Izutani | 60/277 |
| 5,203,165 | 4/1993 | Wild | 60/277 |
| 5,214,915 | 6/1993 | Schneider | 60/277 |

FOREIGN PATENT DOCUMENTS 60-24445 2/1985 Japan .

63-195351 8/1988 Japan .

*Primary Examiner*—Douglas Hart

*Attorney, Agent, or Firm*—Oliff & Berridge

[57] ABSTRACT

The air-fuel ratio control device according to the present invention controls the air-fuel ratio of the engine in accordance with the output of the air-fuel ratio sensor disposed on the exhaust gas passage upstream of the three-way reducing and oxidizing catalyst. Further, to compensate for the change in the output characteristics of the upstream air-fuel ratio sensor, the output of the upstream air-fuel ratio sensor is corrected in accordance with the output of another air-fuel ratio sensor disposed on the exhaust gas passage downstream of the catalyst. Since the response of the downstream air-fuel ratio sensor is delayed due to the $O_2$ storage capacity of the catalyst, the air-fuel ratio control device in the present invention predicts the future value, by a specified time, of the output of the downstream air-fuel ratio sensor based on the history of the change in the output of the upstream air-fuel ratio sensor and the present output of the downstream air-fuel ratio sensor. Since the output of the upstream air-fuel ratio sensor is corrected based on the predicted output of the downstream air-fuel ratio sensor, precise air-fuel ratio control can be achieved by eliminating the delay in the response of the downstream air-fuel ratio sensor caused by the $O_2$ storage capacity of the catalyst.

12 Claims, 5 Drawing Sheets

AIR-FUEL RATIO CONTROL DEVICE FOR AN ENGINE

BACKGROUND OF THE INVENTION

1. Field of the Invention

The present invention relates to an air-fuel ratio control device for an internal combustion engine, and more specifically, relates to an air-fuel ratio control device which controls the air-fuel ratio of the engine based on the outputs of air-fuel ratio sensors disposed on an exhaust gas passage upstream and downstream of a catalytic converter.

2. Description of the Related Art

Three-way reducing and oxidizing catalytic converters are commonly used in order to remove three pollutants, i.e., $NO_x$, HC, and CO components in the exhaust gas of an internal combustion engine. Generally, the catalyst used in such converters is able to remove the these three pollutants from the exhaust gas simultaneously only when the air-fuel ratio of the exhaust gas is kept in a narrow range near the stoichiometric air-fuel ratio. Therefore, in order to reduce the emission of the exhaust gas, it is important to keep the air-fuel ratio of the exhaust gas in the region near the stoichiometric air-fuel ratio.

For this purpose, an air-fuel ratio control device for controlling the air-fuel ratio of an engine by feedback control based on an output of one air-fuel ratio sensor (such as an $O_2$ sensor) disposed on an exhaust passage upstream of a catalytic converter, is used to maintain the air-fuel ratio of the engine in a desired range. This type of the air-fuel ratio control system is known as a single air-fuel ratio sensor system. In the single air-fuel ratio sensor system the air-fuel ratio of the exhaust gas flowing into the catalytic converter is detected by the air-fuel ratio sensor disposed on the exhaust gas passage upstream of the catalytic converter and the amount of the fuel fed to the engine is feedback controlled based on the output of the air-fuel ratio sensor in such a manner that the air-fuel ratio of the exhaust gas flowing into the catalytic converter is maintained at stoichiometric air-fuel ratio. (In this specification, the term "an air-fuel ratio of the exhaust gas" means a ratio of the total amounts of the fuel and the air which are fed to the engine and, if any, to the exhaust gas passage upstream of the catalytic converter. Further, the term "an air-fuel ratio of the engine" means an air-fuel ratio of the combustion in the combustion chamber of the engine. Therefore, the air-fuel ratio of the exhaust gas becomes the same value as the air-fuel ratio of the engine when neither a fuel nor a secondary air is fed to the exhaust gas passage upstream of the catalytic converter.

However, in some cases, the air-fuel ratio of the engine is not precisely controlled at the stoichiometric air-fuel ratio in the single air-fuel ratio sensor system.

In the single air-fuel ratio sensor system, the accuracy of the air-fuel ratio control is directly affected by individual differences in the output characteristics of the air-fuel ratio sensor. Also, the output characteristics of the air-fuel ratio sensor may change gradually due to the deterioration caused by the high temperature of the exhaust gas upstream of the catalytic converter. Further, the exhaust gases from the respective cylinders are not mixed uniformly in the exhaust passage upstream of the catalytic converter, and the output of the air-fuel ratio sensor may reflects only the air-fuel ratio of the exhaust gas from a specific cylinder of the engine, i.e., the air-fuel ratio of the engine as a whole may not be detected by the air-fuel ratio sensor upstream of the catalytic converter.

In order to compensate for the individual difference among cylinders or changes due to the deterioration of the upstream air-fuel ratio sensor, a double sensor system using two air-fuel ratio sensors has been developed (U.S. Pat. No. 4,739,614).

In the double sensor system, air-fuel ratio sensors are disposed upstream and downstream of the catalytic converter in the exhaust passage, and the air-fuel ratio control is carried out based on the output of the downstream air-fuel ratio sensor as well as the output of the upstream air-fuel ratio sensor. Since the exhaust gases from the respective cylinders of the engine are mixed uniformly on the downstream side of the catalytic converter, the air-fuel ratio sensor disposed on the downstream side of the catalytic converter is not affected by a specific cylinder. Further, since the exhaust temperature is low on the downstream side when compared with upstream side, the change in the output characteristics of the downstream air-fuel ratio sensor due to deterioration is relatively small. Therefore, in the double sensor system, the air-fuel ratio of the engine is accurately controlled by correcting the output of the upstream air-fuel ratio sensor based on the output of the downstream air-fuel ratio sensor.

Nevertheless, there is a problem in the double sensor system in the related art. In the double sensor system, there exists a delay in the response of the downstream air-fuel ratio sensor to detect a change in the air-fuel ratio of the engine.

This delay in the response of the downstream air-fuel ratio sensor is caused by an oxygen storage capacity ($O_2$ storage capacity) of the three-way reducing and oxidizing catalyst in the catalytic converter. Usually, the three-way reducing and oxidizing catalyst is provided with a so-called $O_2$ storage capacity, i.e., a capability of absorbing oxygen in the exhaust gas when the air-fuel ratio of the exhaust gas is lean compared with the stoichiometric air-fuel ratio, and releasing the absorbed oxygen when the air-fuel ratio of the exhaust gas is rich compared with the stoichiometric air-fuel ratio. Due to this $O_2$ storage capacity, the atmosphere in the catalytic converter is maintained at near the stoichiometric air-fuel ratio even when the air-fuel ratio of the exhaust gas deviates from the stoichiometric air-fuel ratio for a short period. Though the $O_2$ storage capacity is necessary to utilize the ability of the catalyst to a maximum degree, the response of the downstream air-fuel ratio sensor to the change in the air-fuel ratio of the engine becomes poor due to the absorbing and releasing action of the oxygen by the catalyst.

For example, when the air-fuel ratio of the exhaust gas flowing into the catalytic converter changes from a lean side air-fuel ratio to a rich side air-fuel ratio compared with the stoichiometric air-fuel ratio, the air-fuel ratio of the exhaust gas flowing out from the catalytic converter does not change immediately since the oxygen absorbed in the catalyst is released when the air-fuel ratio of the exhaust gas flowing into the catalyst becomes rich. In this case, the air-fuel ratio of the exhaust gas flowing out from the catalyst changes to rich compared with the stoichiometric air-fuel ratio, only after the oxygen in the catalyst is completely released, i.e., the change in the air-fuel ratio of the exhaust gas downstream of the catalyst is delayed compared with the change in the air-fuel ratio of the exhaust gas upstream of the catalytic converter.

Therefore, when the air-fuel ratio of the engine starts to deviate to the rich air-fuel ratio side from the stoichiometric air-fuel ratio for some reason during air-fuel ratio control, the air-fuel ratio of the engine deviates largely to a rich air-fuel ratio side before the change in the air-fuel ratio of the engine is detected by the downstream air-fuel ratio sensor. A similar delay will occur when the air-fuel ratio of the engine deviates to the lean air-fuel ratio side. Because of this delay in the detection of the air-fuel ratio of the engine by the downstream air-fuel ratio sensor, it is difficult to compensate the output of the upstream air-fuel ratio sensor accurately based on the output of the downstream air-fuel ratio sensor.

To compensate for the delay in the response of the downstream air-fuel ratio sensor, Japanese Unexamined Patent Publication (Kokai) No. 63-195351 proposes a double sensor system which changes the values of the factors used in the feedback control by the upstream air-fuel ratio sensor in accordance with the magnitude of the deviation of the air-fuel ratio detected by the downstream air-fuel ratio sensor from the stoichiometric air-fuel ratio. Namely, in the double sensor system in the above publication, when the deviation of the air-fuel ratio at downstream of the catalytic converter becomes larger, the factors used in the feedback control by the upstream air-fuel ratio sensor are largely changed so that the air-fuel ratio of the engine converges to the stoichiometric air-fuel ratio in short time.

However, in the double sensor system disclosed in Japanese Unexamined Patent Publication (Kokai) No. 63-195351, the factors used in the feedback control are determined in accordance with the output of the downstream air-fuel ratio sensor which has delayed response due to the $O_2$ storage capacity of the catalyst. This means that, in the above double sensor system, when the output of the downstream air-fuel ratio sensor is the same, the factors used in the feedback control are set at the same values regardless of whether the air-fuel ratio of the engine starts to deviate to the rich air-fuel ratio or the lean air-fuel ratio. Therefore, accurate air-fuel ratio control which reflects the tendency of the change in the air-fuel ratio of the engine cannot be achieved by the above double sensor system.

SUMMARY OF THE INVENTION

In view of the above problems in the related art, the object of the present invention is to provide an air-fuel ratio control device for an engine which can control the air-fuel ratio of the engine accurately by eliminating the adverse effect on the response of the downstream air-fuel ratio sensor caused by the 02 storage capacity of the catalyst.

According to the present invention, there is provided a device for an internal combustion engine equipped with an exhaust gas passage and a three-way reducing and oxidizing catalytic converter having an oxygen storage capacity and disposed on the exhaust passage.

The device comprises an upstream air-fuel ratio sensor disposed on the exhaust gas passage upstream of the catalytic converter for detecting an air-fuel ratio of the exhaust gas upstream of the catalytic converter, a downstream air-fuel ratio sensor disposed on the exhaust passage downstream of the catalytic converter for detecting the air-fuel ratio of the exhaust gas downstream of the catalytic converter, a predicting means for predicting a value of the air-fuel ratio of the exhaust gas downstream of the catalytic converter at a specified time after the present time, based on the output of the downstream air-fuel ratio sensor at the present time, and an air-fuel ratio control means for controlling the air-fuel ratio of the engine based on the output of the upstream air-fuel ratio sensor and the predicted future value of the air-fuel ratio of the exhaust gas downstream of the catalytic converter.

BRIEF DESCRIPTION OF THE DRAWINGS

The present invention will be better understood from the description as set forth hereinafter, with reference to the accompanying drawings, in which.

DESCRIPTION OF THE PREFERRED EMBODIMENT

Figure 1:
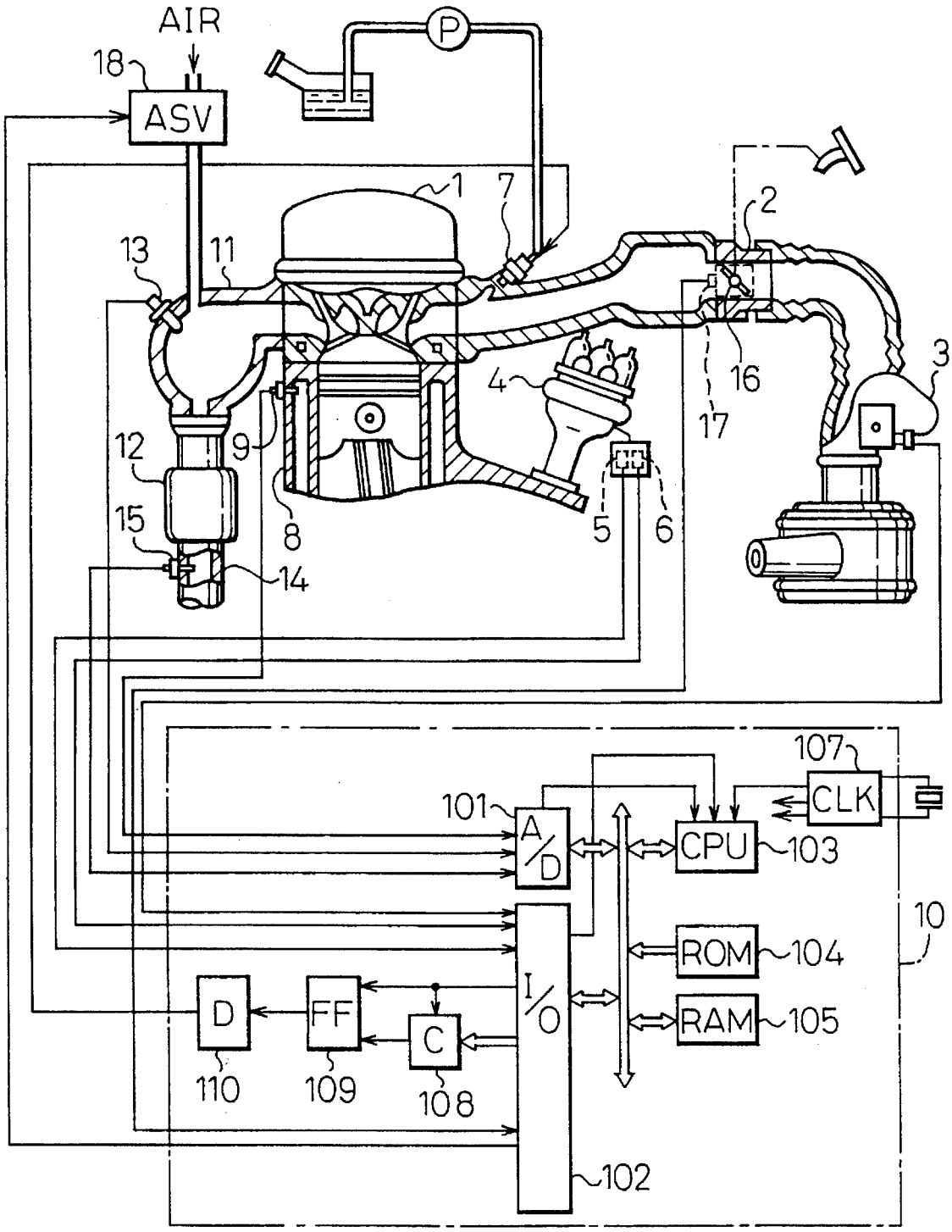
FIG. 1 is a schematic view of an internal combustion engine showing an embodiment of the present invention.

FIG. 1 schematically illustrates an embodiment of the air-fuel ratio control device according to the present invention.

In FIG. 1, reference numeral 1 represents an internal combustion engine for an automobile. An air intake passage 2 of the engine 1 is provided with a potentiometer-type air-flow meter 3 for detecting the amount of air drawn into the engine 1, and generates an analog voltage signal proportional to the amount of air flowing therethrough. The signal from the air-flow meter 3 is transmitted to a multiplexer-incorporating analog-to-digital (A/D) converter 101 of the control circuit 10.

Crank angle sensors 5 and 6, for detecting the angle of the crankshaft (not shown) of the engine 1, are disposed at a distributor 4 of the engine 1.

In this embodiment, the crank angle sensor 5 generates a pulse signal at every 720° crank angle and the crank angle sensor 6 generates a pulse signal at every 30° crank angle. The pulse signals from the crank angle sensors 5 and 6 are supplied to an input/output(I/O) interface 102 of the control circuit 10.

Further, the pulse signal of the crank angle sensor 6 is then fed to an interrupt terminal of a central processing unit (CPU) 103.

In the intake passage 2, a fuel injection valve 7 is provided at an inlet port of each cylinder of the engine 1, for supplying pressurized fuel from the fuel system to the cylinders of the engine.

A coolant temperature sensor 9 for detecting the temperature of the coolant is disposed on a water jacket of a cylinder block 8 of the engine 1. The coolant temperature sensor 9 generates an analog voltage signal in response to the temperature THW of the coolant, and transmits this signal to the A/D converter 101 of the control circuit 10.

In the exhaust system, a three-way reducing and oxidizing catalytic converter 12 is disposed on the exhaust passage downstream of the exhaust manifold 11. The catalytic converter 12 has an $O_2$ storage capacity and is capable of removing three pollutants from the exhaust gas, i.e., CO, HC and $NO_x$, simultaneously.

A first (upstream) air-fuel ratio sensor 13 is provided at the exhaust manifold 11, i.e., upstream of the catalytic converter 12, and a second (downstream) $O_2$ sensor 15 is disposed at an exhaust pipe 14 downstream of the catalytic converter 12.

In this embodiment, an air-fuel ratio sensor which generates a continuous output voltage signal having one-to-one correspondence with the air-fuel ratio of the exhaust gas is used as the upstream air-fuel ratio sensor 13, and a conventional $O_2$ sensor is used as the downstream air-fuel ratio sensor 15.

More specifically, the upstream air-fuel ratio sensor 13 generates a continuous voltage output corresponding to the air-fuel ratio in over a wide range of air-fuel ratios of the exhaust gas. The downstream $O_2$ sensor 15 also generates an output signal corresponding to the air-fuel ratio of the exhaust gas downstream of the catalytic converter 12. However, in contrast to the upstream air-fuel ratio sensor 13, the downstream $O_2$ sensor 15 generates only a two state voltage output signal depending on whether the air-fuel ratio of the exhaust gas is on the rich side or on the lean side compared with the stoichiometric air-fuel ratio. In the explanation hereinafter, the upstream air-fuel ratio sensor 13 is referred to as "A/F sensor 13" and the downstream air-fuel ratio sensor 15 is referred to as "$O_2$ sensor 15" to distinguish them from each other.

As for the type of the A/F sensor 13 used in this embodiment, an explanation will be given later.

The signals output by the A/F sensor 13 and the $O_2$ sensor 15 are transmitted to the A/D converter 101 of the control circuit 10.

The control circuit 10, which may consist of a microcomputer, further comprises a central processing unit (CPU) 103, a read-only-memory (ROM) 104 for storing a main routine and interrupt routines such as a fuel injection routine and an ignition timing routine, and constants, etc., a random-access-memory (RAM) 105 for storing temporary data, and a clock generator 107 for generating various clock signals.

A throttle valve 16 operated by a vehicle driver, is provided in the intake air passage 2, together with an idle switch 17 for detecting the opening of the throttle valve and generating a signal ("LL signal") when the throttle valve 16 is fully closed. This LL signal is fed to the I/O interface 102 of the control circuit 10.

Reference numeral 18 designates a secondary air supply valve for introducing secondary air to the exhaust manifold 11, thereby reducing the emission of HC and CO during a deceleration or an idling operation of the engine.

A down counter 108, a flip-flop 109, and a drive circuit 110 are provided in the control circuit 10 for controlling the fuel injection valve 7.

When a fuel injection amount fi is calculated in a routine, as explained later, the amount fi is preset in the down counter 108, and simultaneously, the flip-flop 109 is set, and as a result, the drive circuit 110 initiates the activation of the fuel injection valve 7. On the other hand, the down counter 108 counts up the clock signal from the clock generator 107, and finally, a logic 1 signal is generated from the terminal of the down counter 108, to reset the flip-flop 109, so that the drive circuit 110 stops the activation of the fuel injection valve 7, whereby an amount of fuel corresponding to the fuel injection amount fi is supplied to the cylinders.

Interrupts occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q from the air-flow meter 3 and the coolant temperature data THW from the coolant sensor 9 are fetched by an A/D conversion routine(s) executed at predetermined intervals, and then stored in the RAM 105; i.e., the data Q and THW in the RAM 105 are updated at predetermined intervals. The engine speed Ne is calculated by an interrupt routine executed at every 30° crank angle, i.e., at every pulse signal of the crank angle sensor 6, and is stored in the RAM 105.

Next, the construction of the upstream A/F sensor 13 will be explained with reference to FIG. 5.

There are several types of the air-fuel ratio sensor which can be used as upstream A/F sensor 13. In this embodiment, the air-fuel ratio sensor of the type disclosed in Japanese Unexamined Patent Publication (Kokai) No. 60-24445 is used as upstream A/F sensor 13, however, other types of air-fuel ratio sensors also can be used as upstream A/F sensor 13 in this invention.

Figure 5:
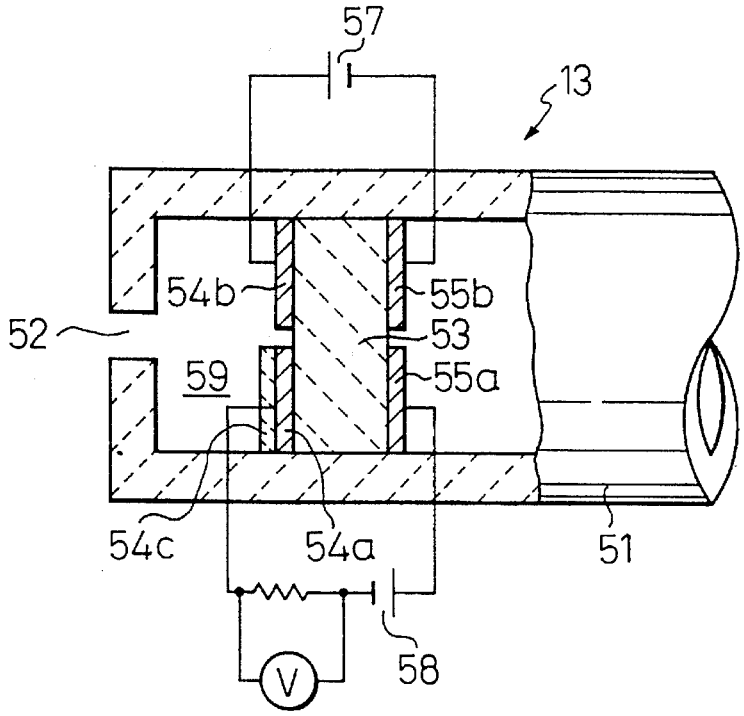
FIG. 5 is a drawing explaining a typical construction of the upstream air-fuel ratio sensor.

FIG. 5 schematically shows the construction of the A/F sensor 13 used in this embodiment. In FIG. 5, the A/F sensor 13 comprises a tubular body 51 made of ceramic material having a gas diffusion hole 52 at the closed end thereof. Numeral 53 shows a disc made of solid electrolyte material such as zirconia disposed in the tubular body 51 of the sensor. On the one side of the disc 53, two semicircular platinum electrodes **54*a* and 54*b* are disposed. Also, two semicircular platinum electrodes 55*a* and 55*b* are disposed on the opposite side of the disc. Further, on the electrode 54*b*, a ceramic coating 54*c* is formed for reducing the amount of oxygen molecules in the exhaust gas to reach the electrode 54*a*. The sensor 13 is installed in the exhaust passage of the engine so that the electrodes 54*a* and 54*b* are exposed to the exhaust gas coming from the gas diffusion hole 52, and the electrodes 55*a* and 55*b* are exposed to the ambient air. Then, the electrode pair 54*b* and 55*b* are connected to a constant DC voltage source 57 tc form an "oxygen pump" which transfers oxygen molecules in the ambient air into a cavity 59 defined by the closed end of the body 51 and the disc 53. The electrode pair 54*a* and 55*a* are also connected to a constant DC voltage source 58, but having reverse polarity to the source 57. The electrode pair 54*a* and 55*a*, together with the solid electrolyte disc 53 and the restriction coating 54*c***, form a lean air-fuel ratio sensor which can detect the air-fuel ratio of the exhaust gas accurately when the air-fuel ratio of the exhaust gas is lean compared to the stoichiometric air-fuel ratio.

Namely, when a DC voltage is imposed between electrodes **54*a* and 55*a* at more than a specified temperature of the solid electrolyte 53, the oxygen molecules in the exhaust gas are ionized on the negative electrode 54*a*. The oxygen ions formed on the negative electrode 54*a* are transferred to the positive electrode 55*a* through the solid electrolyte 53 to form oxygen molecules on the positive electrode 55*a*. By this flow of the oxygen ions, an electric current proportional to the amount of the transferred oxygen ions are formed between electrodes 54*a* and 55*a*. However, since the restriction coating 54*c* on the negative electrode 54*a* hampers the flow of the oxygen molecules therethrough, the amount of the oxygen molecules which reach the negative electrode 54*a*** per unit time is limited to a certain maximum level.

Therefore, the current generated between the electrodes **54*a* and 55*a*** is saturated at a certain level even if the voltage imposed between the electrodes is increased. The maximum amount of the flow of the oxygen molecules, thus the maximum electric current (or saturated current), is roughly proportional to the oxygen concentration of the exhaust gas when the air-fuel ratio of the exhaust gas is lean compared with the stoichiometric air-fuel ratio. Therefore, by imposing a voltage of appropriate level, the oxygen concentration of the lean air-fuel ratio exhaust gas can be detected from the saturated current, and, since the air-fuel ratio of the exhaust gas has a one-to-one correspondence to the oxygen concentration, the air-fuel ratio of the exhaust gas can be also detected from the saturated current.

In the air-fuel ratio sensor 13 in FIG. 5, the oxygen pump formed by the electrodes 54*b* and 55*b* transfers oxygen from the ambient to the cavity 59 at a constant rate. These oxygen molecules mix with the exhaust gas flowing into the cavity 59 through the gas diffusion hole 52. The voltage imposed between the electrodes 54*b* and 55*b* of the oxygen pump is selected so that the constant oxygen flow rate of the oxygen pump is sufficient to establish a lean air-fuel ratio in the cavity 59 over wide variation of the air-fuel ratio of the exhaust gas in the exhaust passage. Therefore, the oxygen concentration in the cavity 59 can be detected by the lean air-fuel ratio sensor formed by the electrodes 54*a* and 55*a* even if the air-fuel ratio of the exhaust gas in the exhaust passage is rich compared to the stoichiometric air-fuel ratio. Since the rate of the oxygen transferred to the cavity 59 by the oxygen pump is constant, the oxygen concentration, i.e., the air-fuel ratio of the exhaust gas in the exhaust passage can be obtained by correcting the output of the lean air-fuel ratio sensor by the value corresponding to the oxygen flow rate of the oxygen pump.

Figure 6:
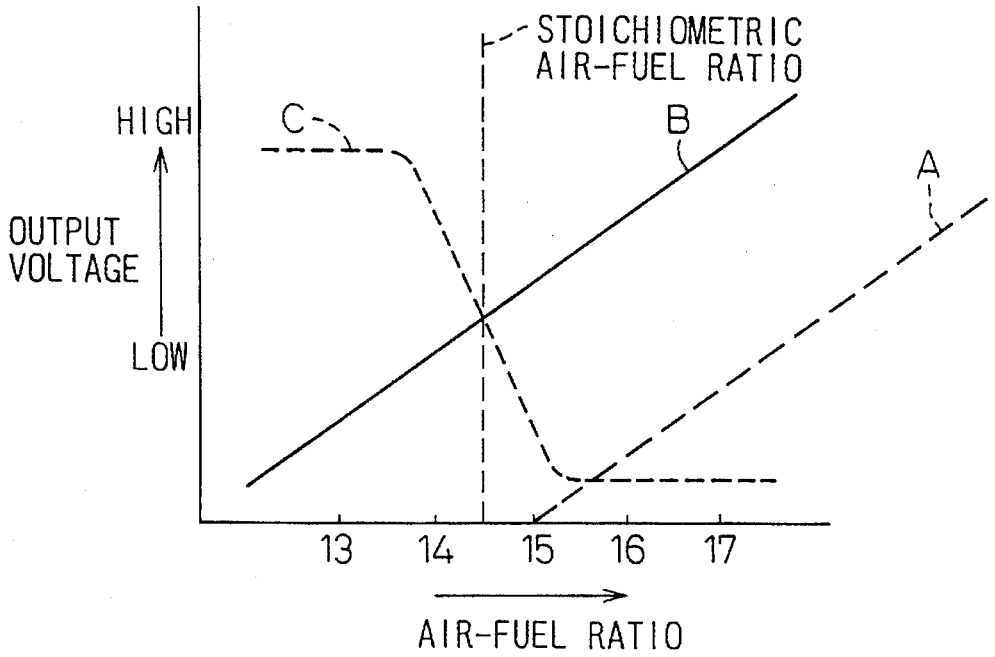
FIG. 6 is a graph showing typical output characteristics of the air-fuel ratio sensors.

FIG. 6 shows an example of the output of the lean air-fuel ratio sensor formed by the electrodes 54*a* and 55*a* (line A), and the overall output of the A/F sensor 13 (line B) after being corrected by the output of the oxygen pump formed by the electrodes 54*b* and 55*b*, where both outputs are shown after being converted to voltage signals. Also in FIG. 6, an example of the output signal of the conventional $O_2$ sensor used as the downstream $O_2$ sensor 15 is shown for reference (line C).

The construction of the $O_2$ sensor 15 is similar to the construction of the lean air-fuel ratio sensor formed by electrodes 54*a* and 55*a*. However, in the $O_2$ sensor, the restriction coating 54*c* is not provided on the electrode. Also, DC continuous voltage is not imposed between the electrodes. In contrast to the lean air-fuel sensor, when the solid electrolyte between the electrodes is heated by the exhaust gas over a specified temperature in the $O_2$ sensor, oxygen ions are transferred from the ambient side (high oxygen concentration side) to the exhaust gas side (low oxygen concentration side), and a DC voltage corresponding to the difference in the oxygen concentration in the exhaust gas and ambient air is generated between the electrodes.

The oxygen concentration in the exhaust gas abruptly changes at the stoichiometric air-fuel ratio, when the air-fuel ratio of the exhaust gas changes from the rich side to the lean side compared with the stoichiometric air-fuel ratio, or vice-versa. Therefore, as shown by line C in FIG. 6, the output of the $O_2$ sensor 15 shows so-called Z-curve characteristics which change abruptly near the region of the stoichiometric air-fuel ratio.

From the above explanation, it will be understood that the output voltage of the upstream A/F sensor 13 (line B in FIG. 6) is substantially proportional to the air-fuel ratio of the exhaust gas over wide air-fuel ratio range of the exhaust gas, whereas the output voltage of the conventional downstream $O_2$ sensor (line C in FIG. 6) only indicates whether the air-fuel ratio of the exhaust gas is rich or lean compared to the stoichiometric air-fuel ratio. Generally, the output response of $O_2$ sensors is faster than A/F sensors, and also a change in the reference output voltage (the output voltage corresponding to the stoichiometric air-fuel ratio) due to aging is smaller than A/F sensors. As explained later, the output of the downstream air-fuel ratio sensor is used for correcting the output of the upstream air-fuel ratio sensor. For this purpose, the downstream air-fuel ratio sensor preferably has stable output characteristics. Also, a fast response is required for the downstream air-fuel ratio sensor to reduce time lag explained above. Therefore, the $O_2$ sensor, rather than the A/F sensor, is used as the downstream air-fuel ratio sensor 15 in this embodiment.

In this embodiment, the control circuit 10 predicts the output of the downstream $O_2$ sensor 15 at the specified time after the present time. The method of the prediction is now explained with reference to FIG. 2.

Figure 2:
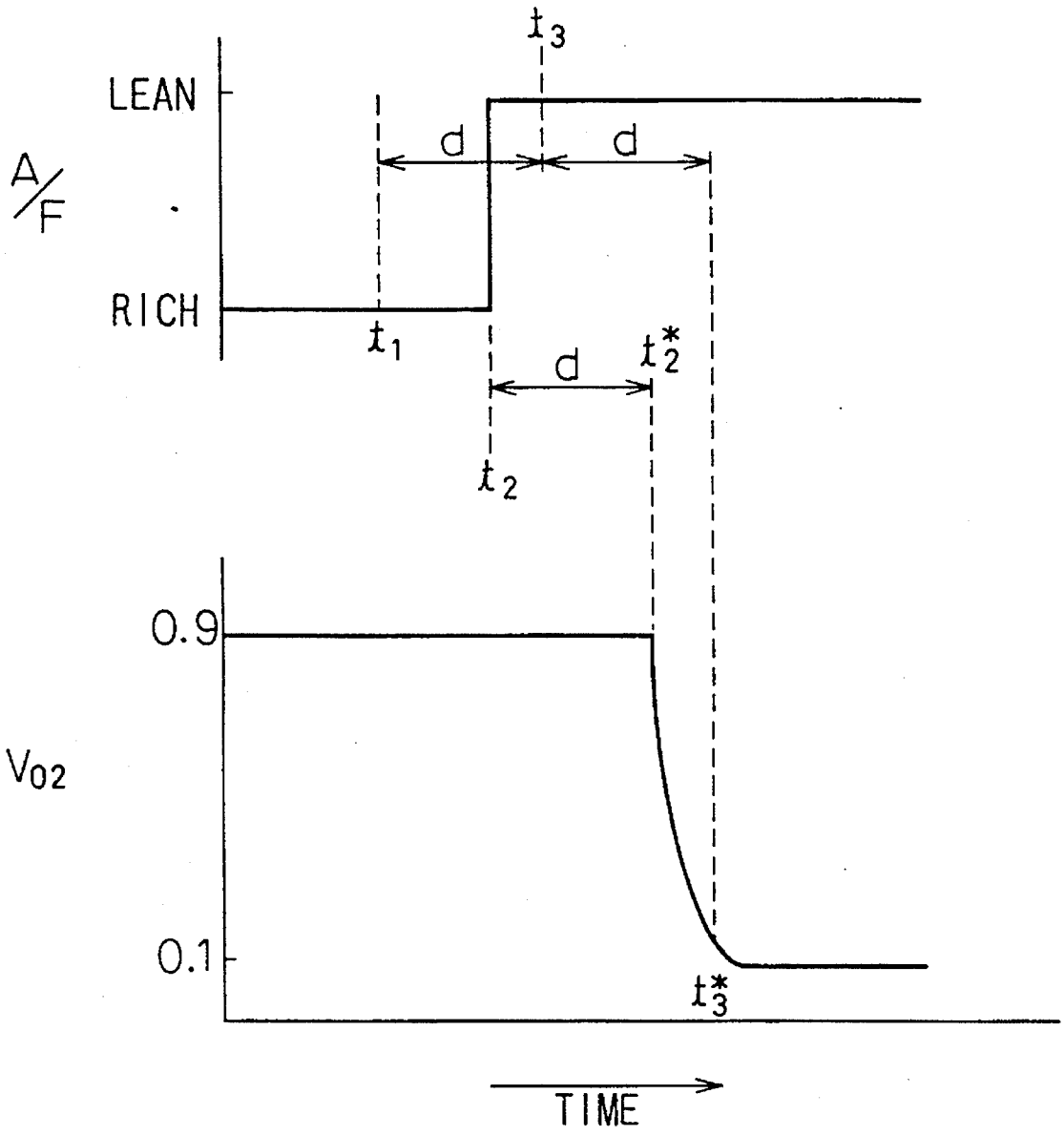
Fig 2 is a timing diagram explaining the principal of the prediction of the output of the downstream air-fuel ratio.

FIG. 2 shows a response of the output of the downstream $O_2$ sensor 15 when the air-fuel ratio of the exhaust gas at upstream of the catalytic converter 12 changes stepwise from the rich air-fuel ratio side to the lean air-fuel ratio side compared with the stoichiometric air-fuel ratio. In FIG. 2, A/F represents the air-fuel ratio upstream of the catalytic converter 12 and $V_{O2}$ represents the output of the downstream $O_2$ sensor 15. As shown in FIG. 2, the upstream air-fuel ratio A/F is maintained at the rich air-fuel ratio side until the moment $t_2$, and changes from the rich side to the lean side stepwise at the moment $t_2$. However, the response of the output $V_{O2}$ of the downstream $O_2$ sensor 15 is delayed by time period d due to the $O_2$ storage capacity of the catalyst, and is maintained at a rich air-fuel ratio side output (e.g., 0.9 volt) until the delay time equal to the time period d has lapsed. Then at the moment $t_2$*, which is time period d after the moment $t_2$, $V_{O2}$ starts to decrease in accordance with the decrease of the amount of the oxygen stored in the catalyst, and eventually reaches a lean air-fuel ratio side output (e.g., 0.1 volt). Namely, the response of $V_{O2}$ has a similar characteristics as a first order lag response system with a delay time equal to the time period d.

As seen from FIG. 2, at the moment $t_3$ immediately after the change in the upstream air-fuel ratio A/F, the output V stays on the rich air-fuel ratio side while the upstream air-fuel ratio A/F has already changed to the lean air-fuel ratio side. The output $V_{O2}$ which reflects the actual upstream air-fuel ratio A/F is obtained only at the moment $t_3$* which is time period d after the moment $t_3$. Therefore, to detect the actual upstream air-fuel ratio A/F at the moment $t_3$ by the downstream $O_2$ sensor 15, the output V at the moment $t_3$*, i.e., the output $V_{O2}$ after the time period d has lapsed from the present time must be used.

However, since the change in the output $V_{O2}$ (i.e., the change in the air-fuel ratio of the exhaust gas downstream of the catalytic converter 12) during the period between the moments $t_3$ and $t_3$* corresponds to the change in the upstream air-fuel ratio A/F during the period between the moments $t_1$ and $t_3$ which precedes by the time period d, it is possible to predict the future value of the output $V_{O2}$ (i.e., value at the moment $t_3$*) at the present time (i.e., the moment $t_3$) based on the history of the change in the upstream air-fuel ratio A/F during the past period between moments $t_1$ and t3.

In this embodiment, the output $V_{O2}$ at the moment after the time period d has lapsed from the present time (i.e., at the moment $t_3$*) is calculated based on the history of the change in the output of the upstream A/F sensor 13 during the time period d before the present time (i.e., the period between the moment $t_1$ and the moment $t_3$) and the present output $V_{O2}$ (i.e., the output at the moment $t_3$) by approximating the response of the downstream $O_2$ sensor 15 using the first order lag response system with the delay time equal to the time period d.

Next, the actual procedure of the above prediction is explained in detail.

First, from the first order lag response model with the delay time equal to time period d, the output $V_{O2}(K)$ of the downstream $O_2$ sensor 15 at the moment K can be expressed by the following equation:

$$V_{O2(K)}=\alpha\cdot V_{O2(K-1)}+\beta\cdot V_{A/F(K-d)} \quad (1)$$

Where, $V_{O2(K-1)}$ stands for the output of the downstream $O_2$ sensor 15 at the moment (K−1) immediately before the moment K, and $V_{A/F(K-d)}$ stands for the output $V_{AF}$ of the upstream A/F sensor 13 at the moment (k−d) which precedes the moment k by the time period d. α and β are empirical factors which depend on types of the three-way catalyst, the output characteristics of the downstream $O_2$ sensor 15, sampling intervals (the time between the moments (k−1) and k, etc., and determined by experiments in advance. The factors α and β may be constant, or alternatively they may be changed in accordance with the magnitude of the output of the downstream $O_2$ sensor 15.

Then, the output $V_{O2(K+d)}$ Of the downstream $O_2$ sensor 15 at the moment (K+d) after time period d has lapsed from the moment K can be calculated by the following procedure, based on the output $V_{O2(K)}$ at the moment K and the above formula (1).

$$[V_{O2(K+1)}] = \alpha \cdot V_{O2(K)} + \beta \cdot V_{A/F(K-d+1)} \quad (21)$$
$$[V_{O2(K+2)}] = \alpha \cdot [V_{O2(K+1)}] + \beta \cdot V_{A/F(K-d+2)} \quad (22)$$
$$[V_{O2(K+3)}] = \alpha \cdot [V_{O2(K+2)}] + \beta \cdot V_{A/F(K-d+3)} \quad (23)$$
$$\vdots$$
$$[V_{O2(K+d)}] = \alpha \cdot [V_{O2(K+d-1)}] + \beta \cdot V_{A/F(K)} \quad (2d)$$

Where, $[V_{O2(i)}]$ (i.e., $[V_{O2(K+)}]$, $[V_{O2(K+2)}]$, . . . , $[V_{O2(K+d)}]$) represents the estimated values of the output of the downstream $O_2$ sensor 15 at the respective moments (i.e., i=K+1, K+2, . . . , K+d). On the other hand, $V_{A/F}^{(i)}$(i.e., $V_{A/F(K-d+1)}$, $V_{A/F(K-d+2)}$ . . . , $V_{A/F(K)}$) are the actual value of the output of the upstream A/F sensor 13.

By the above procedure, the future value of the output of the downstream $O_2$ sensor 15 at the moment after time period d has lapsed from the present time ($[V_{O2(K+d)}]$) can be accurately predicted using the actual values of the outputs of the upstream A/F sensor 13 during the past time period d preceding the present time ($V_{A/F(K-d+1)}$, $V_{A/F(K-d+2)}$ . . . , $V_{A/F(K)}$) and the present output of the downstream $O_2$ sensor 15 ($V_{O2(K)}$).

In this embodiment, the predicted value ($[V_{O2(K+d)}]$) Of the output of the downstream $O_2$ sensor 15 is used for correcting the output of the upstream A/F sensor 13. Since the air-fuel ratio of the engine is controlled in accordance with the output of the upstream A/F sensor 13, if the output of the upstream A/F sensor 13 does not reflect the air-fuel ratio of the exhaust gas accurately due to, for example, the change in the output characteristics caused by aging or non-uniform mixing of the exhaust gas, the air-fuel ratio of the engine cannot be precisely controlled at the stoichiometric air-fuel ratio. This causes a deterioration of drivability and worsening of the exhaust emission.

As explained hereinafter, the output of the upstream A/F sensor 13 in this embodiment is corrected based on the amount of the deviation of the predicted value ($[V_{O2(K+d)}]$) and the output corresponding to the stoichiometric air-fuel ratio of the downstream air-fuel ratio sensor 15. Namely, the output of the upstream A/F sensor 13 is corrected based on the deviation of the air-fuel ratio of the exhaust gas flowing through the catalytic converter 12 from the stoichiometric air-fuel ratio without being affected by the $O_2$ storage capacity of the catalyst. By this correction, the air-fuel ratio of the engine is precisely maintained at the stoichiometric air-fuel ratio even when the output characteristics of the upstream A/F sensor 13 are changed.

The control circuit 10 calculates the correction amount Δ $V_{A/F(K)}$ and corrects the output of the upstream A/F sensor 13 by adding the correction amount Δ $V_{A/F(K)}$ to the present output $V_{A/F(K)}$ of the upstream A/F sensor 13.

The correction amount Δ $V_{A/F(K)}$ is given by the following formula.

$$\Delta V_{A/F(K)} = G1 \cdot \Delta[V_{O2(K+d)}] + G2 \times \left( \sum_{i=0}^{K} \Delta V_{O2(i)} + \sum_{i=K+1}^{K+d} \Delta[V_{O2(i)}] \right) + G3 \cdot (\Delta[V_{O2(K+d)}] - [V_{O2(K+d-1)}] \quad (3)$$

Then, $$V^*_{A/F(K)}=V_{A/F(K)}+\Delta V_{A/F(K)} \quad (4)$$

Where, $V^*_{A/F(K)}$ is the corrected value of the output of the upstream A/F sensor 13 at the moment K, and Δ $V_{O2(i)}]$ (where, i=K+1, K+2, K+3, . . . , K+d) represents the deviation of the predicted value [VO2(i)] and $V_{O2}S$ which is the output of the downstream air-fuel ratio sensor 15 corresponding to the stoichiometric air-fuel ratio, i.e., $\Delta[V_{O2(i)}] = [V_{O2(i)}] - V_{O2}S$.

Further, $$\sum_{i=0}^{K} \Delta V_{O2(i)}$$

is a sum (integration) of the values of Δ $V_{O2}$ (which is the deviation of the output $V_{O2}$ from $V_{O2}S$) from the moment at which the engine starts (i.e., from the moment zero) to the present time (moment K). Similarly, $$\sum_{i=K+1}^{K+d} \Delta[V_{O2(i)}]$$

is a sum (integration) of the values of $\Delta[V_{O2}]$ (which is the deviation of the predicted value $[V_{O2}]$ from $V_{O2}S$) from the moment K+1 to the moment K+d, and $\Delta[V_{O2(K+d)}]-\Delta[V_{O2(K+d-1)}]$ represents the rate of change (derivative) of the value $\Delta[_{O2}]$ at the moment K+d.

Namely, the correction amount Δ $V_{A/F(K)}$ is obtained by a PID (proportional, integral and derivative) process based on the deviation $\Delta[V_{O2}]$. G1, G2 and G3 are gain factors of feedback, and obtained by experiments.

Figure 3:
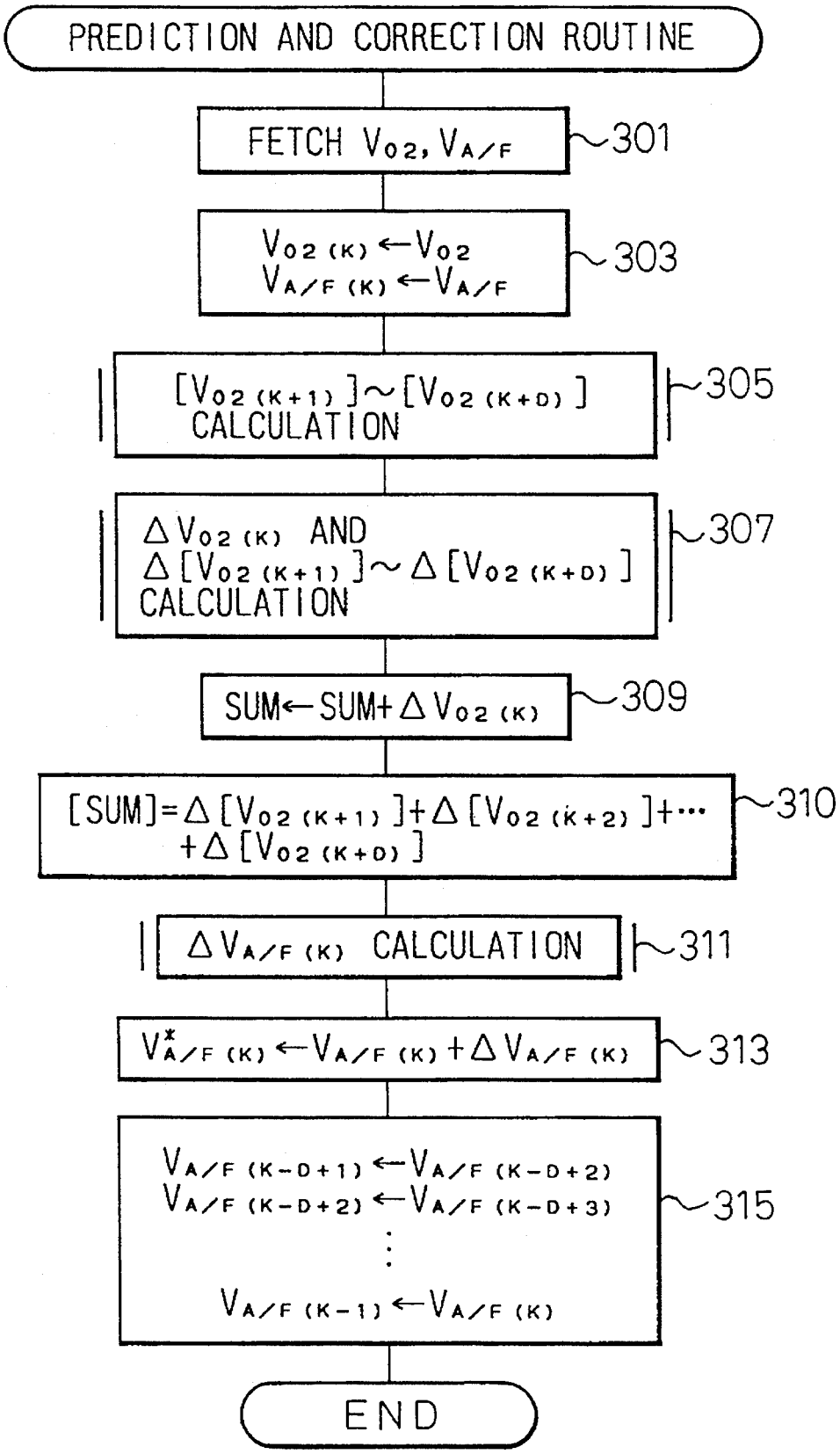
FIG. 3 is a flow-chart showing an embodiment of the routine for predicting the output of the downstream air-fuel ratio sensor.

FIG. 3 shows a flowchart of the prediction of the output of the downstream 02 sensor 15 and the correction of the output of the upstream air-fuel ratio sensor 13. This routine is processed by the control circuit 10 at each predetermined rotation angle of the crankshaft (e.g., every 180° rotation of the crankshaft).

When the routine starts, at step 301 in FIG. 3, an A/D conversion is performed upon the output voltages $V_{A/F}$ and $V_{O2}$ of the downstream $O_2$ sensor 15 and the upstream A/F sensor 13, respectively, and the A/D converted values thereof are fetched from the A/D converter 101. Then, at step 303, the present values $V_{A/F(K)}$ and $V_{O2(K)}$ are updated using these values.

At step 305, the predicted values of the output of the downstream $O_2$ sensor 15 $[V_{O2(K+1)}]$~$[V_{O2(K+D)}]$ are calculated using the formulas (21)~ (2d) and the updated values $V_{A/F(K)}$ and $V_{O2(K)}$, and at step 307, $\Delta V_{O2(K)}$ and $\Delta[V_{O2(K+1)}]$~$\Delta[V_{O2(K+D)}]$ which are the deviations of the actual value $V_{O2(K)}$ and the predicted values $[V_{O2(k+1)}]$~$[V_{O2(K+D)}]$ from the output $V_{O2}$ S corresponding the stoichiometric air-fuel ratio, respectively, are calculated. Further, at step 309, the sum (integration) of the deviation $\Delta V_{O2}$ of the actual value $V_{O2}$ is calculated from the moment of engine start to the present time K, and the result is stored in RAM 105 as a parameter SUM. Similarly, the sum (integration) of the deviation of the predicted values $$\Delta[V_{O2(K+1)}] \sim \Delta[V_{O2(K+D)}], \text{ i.e., } \sum_{i=K+1}^{K+D} \Delta[V_{O2(i)}]$$

is calculated and stored in RAM 105 as a parameter [SUM] at step 310.

Then, at step 311 the correction amount $\Delta V_{A/F(K)}$ is calculated by the formula (3) above, and, at step 313, the corrected output $V^*_{A/F(K)}$ of the upstream A/F sensor 13 is obtained from the formula (4). The values $V_{A/F(K-D+1)}$~$V_{A/F(K-1)}$ are renewed at step 315 to prepare the next execution of the routine, and after the renewal of these values, the routine terminates this time. In this routine, D stands for the number of executions of the routine which corresponds the time period d (the delay time of the first order lag response model) in FIG. 2, and in this embodiment, for example, D is set at 2~4 times. Namely, the output of the upstream A/F sensor 13 is corrected based on the predicted value of the output of the downstream $O_2$ sensor 15 at the moment after the crankshaft rotates 1~2 times from the present time.

Next, the air-fuel ratio control based on the corrected output $V^*_{A/F}$ of the upstream air-fuel ratio sensor 13 is explained.

There are several types of the air-fuel ratio control based on the output of the upstream A/F sensor. In this embodiment, an air-fuel ratio control using the modern control theory is used. In this air-fuel ratio control, the amount of the oxygen stored in the catalyst is maintained at a predetermined level to utilize the $O_2$ storage capacity of the catalyst to a maximum degree while accurately keeping the air-fuel ratio of the engine at the stoichiometric air-fuel ratio. This air-fuel ratio control system is disclosed in the copending U.S. patent application Ser. No. 08/217109, and disclosures thereof are incorporated into the present specification by reference thereto.

In this air-fuel ratio control system, first, an amount of the air mc drawn into the cylinders of the engine per one revolution of the engine (cylinder intake air) is calculated from the output of the air-flow meter 3 and the engine revolution. The air-fuel ratio α of the engine is determined from the corrected output $V^*_{A/F}$ of the upstream A/F sensor 13. The amount of the fuel fc actually fed to the cylinders is, then calculated by fc=mc/α. Also, a target amount of the fuel fcr required to keep the air-fuel ratio of the engine at the stoichiometric air-fuel ratio is calculated by fcr=mc/(α·r), where r is the stoichiometric air-fuel ratio. The fuel injection amount fi is determined in such a manner that both the deviation fc–fcr and x1 which is the integration of the deviation by time become zero simultaneously.

When determining the fuel injection amount fl, the amount of the fuel which attaches to the wall surface of the inlet port is considered. Since a part of the fuel injected from the fuel injection valve 7 attaches to the wall of the inlet port and is not fed to a cylinder directly. Therefore, the fuel injection amount and the amount of the fuel fed to the cylinders are usually different. In this embodiment, the fuel injection amount is controlled precisely with consideration of the fuel attached to the inlet port wall.

By controlling the fuel injection amount fi in such a manner that both the deviation of the amount of the fuel fc actually fed to the cylinders from the target amount of the fuel fcr and the integration of the deviation becomes zero simultaneously, it becomes possible to store a predetermined amount of oxygen in the catalyst while improving the response of the air-fuel ratio control.

Figure 4:
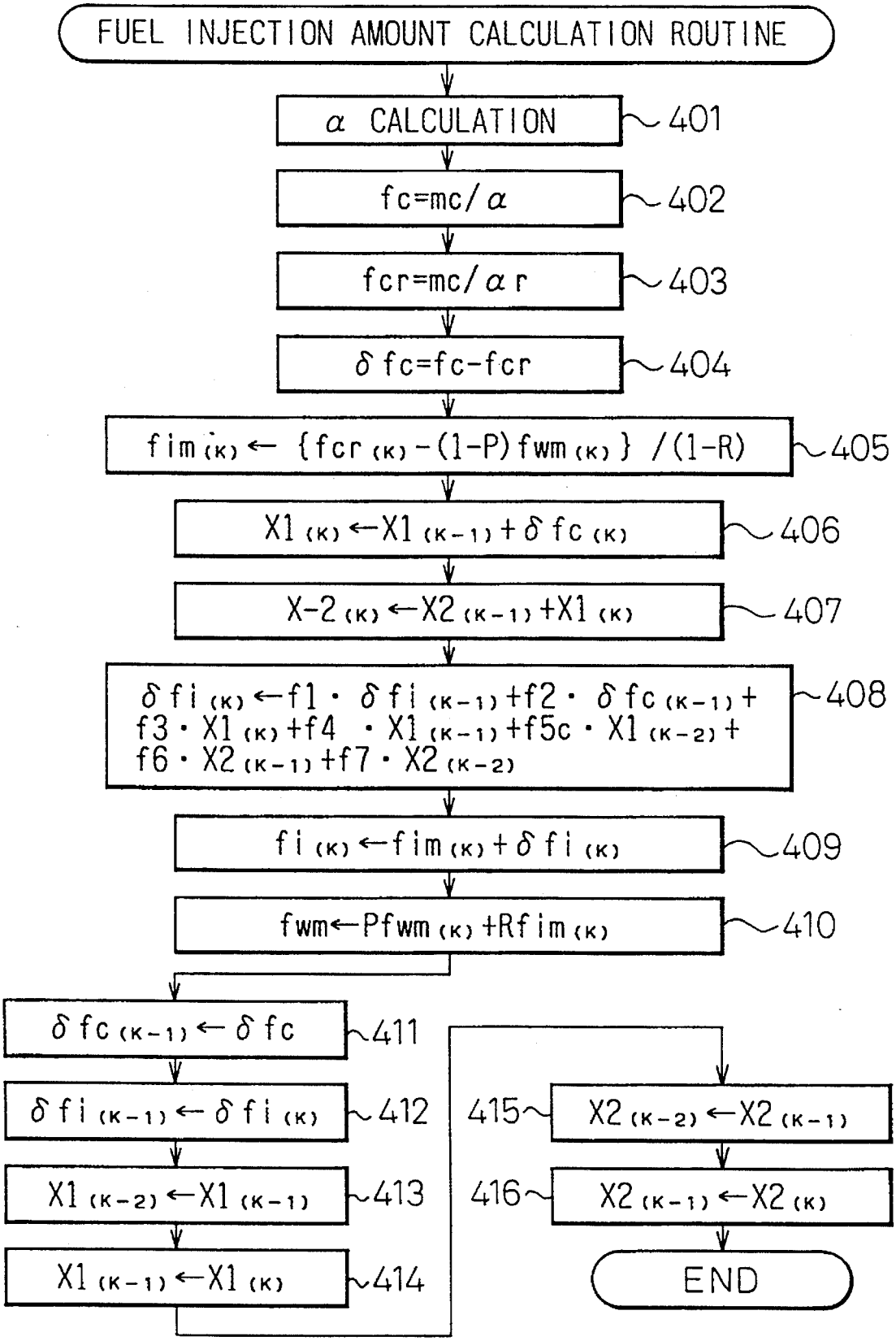
FIG. 4 is a flow-chart showing an embodiment of the air-fuel ratio control routine based on the output of the upstream air-fuel ratio sensor.

FIG. 4 is a flow-chart of the fuel injection amount calculation routine in this embodiment. This routine is processed by the control circuit 10 at each predetermined rotation angle of the of the crankshaft of the engine (for example, every 360° rotation of the crankshaft.

When the routine starts in FIG. 4, the air-fuel ratio α of the engine is calculated at step 401 using the corrected output $V^*_{A/F}$ Of the upstream A/F sensor 13 and the output characteristics thereof shown in FIG. 6. At steps 402 and 403, then the actual amount fc of the fuel fed to the cylinders and the target amount of the fuel fcr are calculated. At step 404, the deviation δ fc is calculated by, δ fc=fc–fcr.

At step 404, a nominal value fim of the fuel injection amount fi is calculated by, $$fim_{(K)}=\{fcr_{(k)}-(1-P)\cdot fwm_{(K)}\}/(1-R)$$

In this air-fuel ratio control, the fuel injection amount fi, amount of the fuel fw attaches to the inlet port wall, the amount of the fuel fc fed to the cylinders are expressed by the sums of the nominal values fim, fwm, fcm and the deviation δ fi, δ fw, δ fc, respectively. Namely, $$fi=fim+\delta fi$$

$$fw=fwm+\delta fw, \text{ and}$$

$$fc=fcm+\delta fc$$

Further, it is assumed that there are relationships between these values expressed by the following model equations.

$$fW_{(K+1)}=P\cdot fw_{(K)}+R\cdot fi_{(K)}$$

$$fC_{(K)}=(1-P)\cdot fW_{(K)}+(1-R)\cdot fi_{(K)}$$

$$fWm_{(K+1)}=P\cdot fwm_{(K)}+R\cdot fim_{(K)}$$

$$fcm_{(K)}=(1P)\cdot fwm_{(K)}+(1-R)\cdot fim_{(K)}$$

$$fcm_{(K)}=fcr_{(K)}$$

In the above equations, P and R are predetermined constants, and the parameters with the suffix K represent the values when the routine is executed this timer and the parameters with the suffix (K–1) represent the values when the routine was last executed.

The nominal value fim of the fuel injection amount fi is calculated at step 405 by modifying the above model equations.

Next, at step 406, xl which is the integration of the deviation 6fc is calculated by, $$x1_{(K)}=X1_{(K-1)}+fC_{(K)}$$

and at step 407, x2, which is the further integration of xl is calculated by, $$x2_{(K)}=X2_{(K-1)}+Xl_{(K)}$$

At step 408, then the deviation δ fi is calculated using the above parameters fi, δ fc, xl, x2, etc., by, $$\delta fi_{(K)}=f1\cdot\delta fi_{(K-1)}+f2\cdot\delta fc_{(K-1)}+f3\cdot x1_{(K)}+f4\cdot x1_{(K-1)}+f5\cdot x1_{(K-2)}+f6\cdot x2_{(K-1)}+f7\cdot x2_{(K-2)}$$

where, fl through f7 are predetermined constants. The fuel injection amount fi is calculated at step using the nominal value fim and the deviation δ fi by, $$fi_{(K)}=fim_{(K)}+\delta fi_{(K)}$$

After completing the calculation of the fuel injection amount fi, the nominal value fwm of the amount of the fuel attache to the inlet port wall is calculated at step 410 to prepare next execution of the routine by, $$fwm=P\cdot fwm_{(K)}+R\cdot fim_{(K)},$$

and the values $\delta fi_{(K-1)}$, $\delta fc_{(K-i)}$, $Xl_{(K-1)}$, $Xl_{(K-2)}$, $X2_{(K-1)}$, and $X2_{(K-2)}$ are updated at steps 411 through 416 based on the values obtained by the present execution of the routine.

As explained before, when the fuel injection amount fi is determined by the above routine, the fuel injection amount (fuel injection time) fi is preset in the down counter 108 by a fuel injection routine (not shown) executed by the control circuit 10, and the drive circuit 110 operates the fuel injection valve 7 to inject the amount of the fuel corresponding fi to the inlet ports of the cylinders.

According to the present embodiment, the output of the upstream A/F sensor 13 is corrected based on the predicted future value of the output of the downstream $O_2$ sensor 15, and the fuel injection amount is controlled in accordance with the corrected value of the output of the upstream A/F sensor 13. Therefore, accurate air-fuel ratio control is achieved since the deviation of the air-fuel ratio of the engine is corrected within a very short time.

I claim:

1. An air-fuel ratio control device for an internal combustion engine having an exhaust gas passage, said engine comprising, a three-way reducing and oxidizing catalytic converter having an oxygen storage capacity and disposed on said exhaust passage, said air-fuel ratio control device comprising:

an upstream air-fuel ratio sensor disposed on the exhaust gas passage upstream of said catalytic converter for detecting an air-fuel ratio of the exhaust gas upstream of said catalytic converter;

a downstream air-fuel ratio sensor disposed on the exhaust passage downstream of said catalytic converter for detecting the air-fuel ratio of the exhaust gas downstream of said catalytic converter;

a predicting means for predicting a value of the air-fuel ratio of the exhaust gas downstream of said catalytic converter at a specified time after the present time, based on the output of said downstream air-fuel ratio sensor at the present time; and, an air-fuel ratio control means for controlling the air-fuel ratio of said engine based on said output of the upstream air-fuel ratio sensor and said predicted value of the air-fuel ratio of the exhaust gas downstream of said catalytic converter.

2. A device according to claim 1, wherein said predicting means predicts said value of the air-fuel ratio at the specified time after the present time based on the output response of said upstream air-fuel ratio sensor during a period from a specified time before the present time to the present time, and the output of said downstream air-fuel ratio sensor at the present time.

3. A device according to claim 2, wherein said specified time at which value of the air-fuel ratio is predicted is equal to a delay time between the moment at which a change in the air-fuel ratio of the exhaust gas upstream of the catalytic converter occurs and the moment at which said change is detected by said downstream air-fuel ratio sensor said delay time being caused by said oxygen storage capacity of said catalytic converter.

4. A device according to claim 3, wherein said predicting means predicts said value of the air-fuel ratio of the exhaust gas downstream of said catalytic converter by approximating the response of the air-fuel ratio of the exhaust gas downstream of the catalytic converter to the change of the air-fuel ratio of the exhaust gas upstream of the catalytic converter by a first order lag system.

5. A device according to claim 4, wherein said air-fuel ratio control means comprising, a correction means for correcting the output of said upstream air-fuel ratio sensor in accordance with a deviation of said predicted value of the air-fuel ratio of the exhaust gas downstream of said catalytic converter from the stoichiometric air-fuel ratio, and a means for controlling the air-fuel ratio of said engine based on said corrected output of said upstream air-fuel ratio sensor.

6. A device according to claim 5, wherein said upstream air-fuel ratio sensor is an A/F sensor which generates a continuous output signal corresponding to the air-fuel ratio of the exhaust gas, and said downstream air-fuel ratio sensor is an $O_2$ sensor which generates an output signal which changes in accordance with whether the air-fuel ratio of the exhaust gas is rich or lean compared with a stoichiometric air-fuel ratio.

7. An air-fuel ratio control device for an internal combustion engine having an exhaust gas passage, said engine comprising, a three-way reducing and oxidizing catalytic converter having an oxygen storage capacity and disposed on said exhaust passage, said air-fuel ratio control device comprising:

an upstream air-fuel ratio sensor disposed on the exhaust gas passage upstream of said catalytic converter for detecting an air-fuel ratio of the exhaust gas upstream of said catalytic converter;

a downstream air-fuel ratio sensor disposed on the exhaust passage downstream of said catalytic converter for detecting the air-fuel ratio of the exhaust gas downstream of said catalytic converter;

a predicting means for predicting a value of the output of said downstream air-fuel ratio sensor at a specified time after the present time, based on the output of said downstream air-fuel ratio sensor at the present time; and, an air-fuel ratio control means for controlling the air-fuel ratio of said engine based on said output of the upstream air-fuel ratio sensor and said predicted future value of the output of the downstream air-fuel ratio sensor.

8. A device according to claim 7, wherein said predicting means predicts said future value of the output of said downstream air-fuel ratio sensor based on the output response of said upstream air-fuel ratio sensor during a period from a specified time before the present time to the present time, and the present output of said downstream air-fuel ratio sensor.

9. A device according to claim 8, wherein said specified time at which the output of said downstream air-fuel ratio sensor is predicted is equal to a delay time between the moment at which a change in the air-fuel ratio of the exhaust gas upstream of the catalytic converter occurs and the moment at which said change is detected by said downstream air-fuel ratio sensor, said delay time being caused by said oxygen storage capacity of said catalytic converter.

10. A device according to claim 9, wherein said predicting means predicts said future value of the output of said downstream air-fuel ratio sensor by approximating the response of the output of the downstream air-fuel ratio sensor to the change of the output of said upstream air-fuel ratio sensor by a first order lag system.

11. A device according to claim 10, wherein said air-fuel ratio control means comprises, a correction means for correcting the output of said upstream air-fuel ratio sensor in accordance with a deviation of said predicted future value of the output of said downstream air-fuel ratio sensor from the value of the output of said downstream air-fuel ratio sensor corresponding to a stoichiometric air-fuel ratio, and a means for controlling the air-fuel ratio of said engine based on said corrected output of said upstream air-fuel ratio sensor.

12. A device according to claim 11, wherein said upstream air-fuel ratio sensor is an A/F sensor which generates a continuous output signal corresponding to the air-fuel ratio of the exhaust gas, and said downstream air-fuel ratio sensor is an $O_2$ sensor which generates an output signal which changes in accordance with whether the air-fuel ratio of the exhaust gas is rich or lean compared with a stoichiometric air-fuel ratio.

* * * * *